United States Patent [19]

Gogniat et al.

[11] Patent Number: 4,727,525

[45] Date of Patent: Feb. 23, 1988

[54] WATCH CASE

[75] Inventors: Paul Gogniat, Bienne; Françoise Albrecht, Pieterlen; Renato Scarinzi; Marco Scarinzi, both of Bienne, Switzerland

[73] Assignee: Montres Rado S.A., Lengnau, Switzerland

[21] Appl. No.: 841,412

[22] Filed: Mar. 19, 1986

[30] Foreign Application Priority Data

Apr. 9, 1985 [CH] Switzerland ..... 01507/85

[51] Int. Cl.[4] ..... G04B 37/00

[52] U.S. Cl. ..... 368/294

[58] Field of Search ..... 368/276, 284, 294–296

[56] References Cited

U.S. PATENT DOCUMENTS

| | | | |
|---|---|---|---|
| 1,333,194 | 3/1920 | Wachter | 368/294 |
| 1,536,607 | 5/1925 | Buhlman | 368/294 |
| 2,792,684 | 5/1957 | Dinstman | 368/294 |
| 4,390,288 | 6/1983 | Arnoux | 368/276 |
| 4,464,063 | 8/1984 | Gogniat | 368/294 |
| 4,490,052 | 12/1984 | Gogniat | 368/294 |
| 4,558,956 | 12/1985 | Bettschen | 368/294 |

FOREIGN PATENT DOCUMENTS

| | | | |
|---|---|---|---|
| 1837081 | 8/1961 | Fed. Rep. of Germany . | |
| 2836650 | 11/1979 | Fed. Rep. of Germany | 368/276 |
| 283122 | 9/1952 | Switzerland . | |
| 814187 | 6/1959 | United Kingdom . | |

*Primary Examiner*—Vit W. Miska

*Attorney, Agent, or Firm*—Sughrue, Mion, Zinn, Macpeak, and Seas

[57] ABSTRACT

The watch case including a back cover, a caseband, a crystal, the peripheral zone of which entirely covers the caseband, a casing ring including at least one packing, a pair of supports facing one another fixed to the caseband and forming therewith a slot in which the crystal may be engaged and means for displacing the casing ring in order to compress the packing against the internal surface of the crystal and block said crystal against the supports. The crystal exhibits at least in its peripheral zone a spherical form of constant thickness. The upper surface of the caseband has the form of a part of a sphere the radius of which is substantially equal to that of the internal surface of the crystal. During assembly the internal surface of the crystal is made to slide over the upper surface of the caseband with a rotational motion resulting from the sliding of a spherical surface over part of a sphere.

10 Claims, 7 Drawing Figures

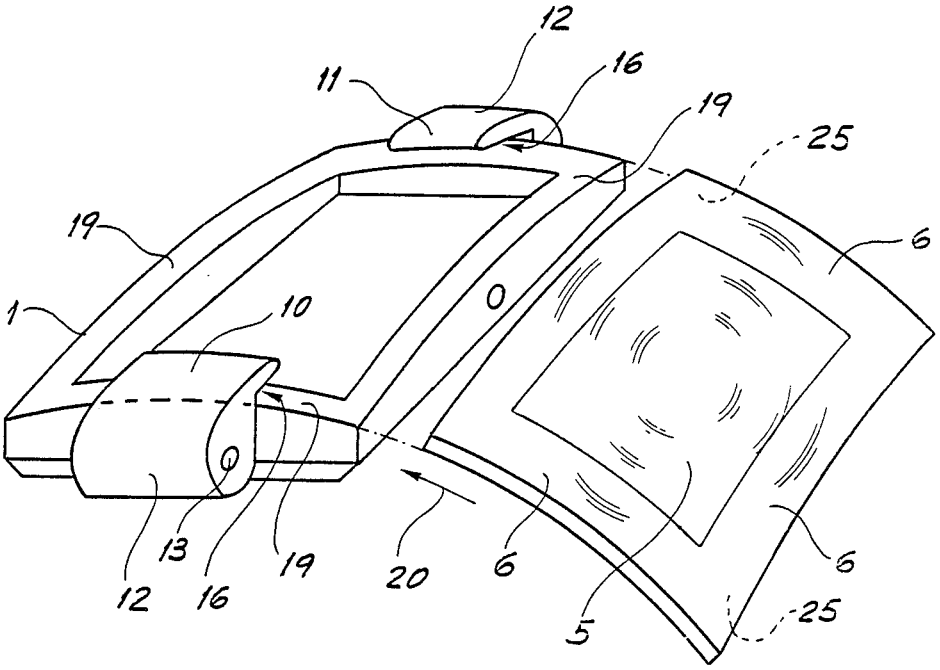
Fig. 4
Fig. 5
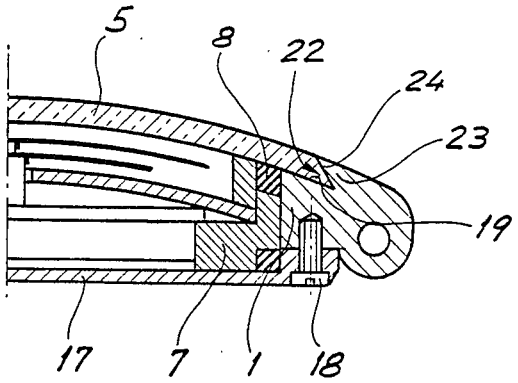

WATCH CASE

This invention concerns a watch case comprising a back cover, a caseband provided with a housing intended to receive a movement surmounted by a dial, a crystal the peripheral zone of which covers at least partially the caseband, a casing ring arranged between the movement and the caseband and including a moisture resistant packing at least on its upper surface, at least two supports fixed to the caseband and forming therewith a slot in which the crystal may be engaged and means for displacing the casing ring operable from the case exterior in order to compress said packing against the internal surface of the crystal and block said crystal against said supports.

BACKGROUND OF THE INVENTION

A watch case having the characteristics which have just been listed is known from the Swiss Pat. No. 643,425 corresponding to U.S. Pat. No. 4,490,052. It comprises in particular a caseband on the upper surface of which is fastened a planar crystal by means of fixation means forming slots in which the edges of the crystal are held after having been laterally engaged therein and a seal placed against the periphery of the lower surface of the crystal. The slots in the fixation means are defined by two surfaces facing one another between which the crystal is engaged, the upper surface of the slots bearing against the upper surface of the crystal. The case includes moreover means for urging the seal against the lower surface of the crystal only after engagement of the crystal in the slots.

It is evident that the invention described in the cited patent is confined to watch cases equipped with a planar crystal and that it gives no teaching which would enable the application thereof to a crystal having the form of a spherical cap.

A crystal having this latter form is interesting since on the one hand it gives the impression that the watch is very thin, on the condition that said crystal is mounted having its edges matching the edges of the caseband at least on a major portion of the periphery, and on the other hand it exhibits better shock resistance than when a planar crystal is employed.

SUMMARY OF THE INVENTION

Thus, the main objective of the invention is to provide a watch case the crystal of which exhibits at least in its peripheral zone a spherical form having substantially constant thickness and the caseband of which has the form of a part of a sphere, the radius of which is substantially equal to the radius exhibited by the internal surface of the crystal in said peripheral zone. In addition, the manner of fastening the crystal to the caseband remains the same as that which has been described in respect of the cited patent and which presents the same advantages already mentioned.

BRIEF DESCRIPTION OF THE DRAWINGS

FIG. 4 is a perspective view which shows the assembly of the crystal on the caseband of the watch shown in FIG. 1;

FIG. 5 is a variant in the execution of the construction shown on FIG. 2;

DESCRIPTION OF THE PREFERRED EMBODIMENT

Figure 1:
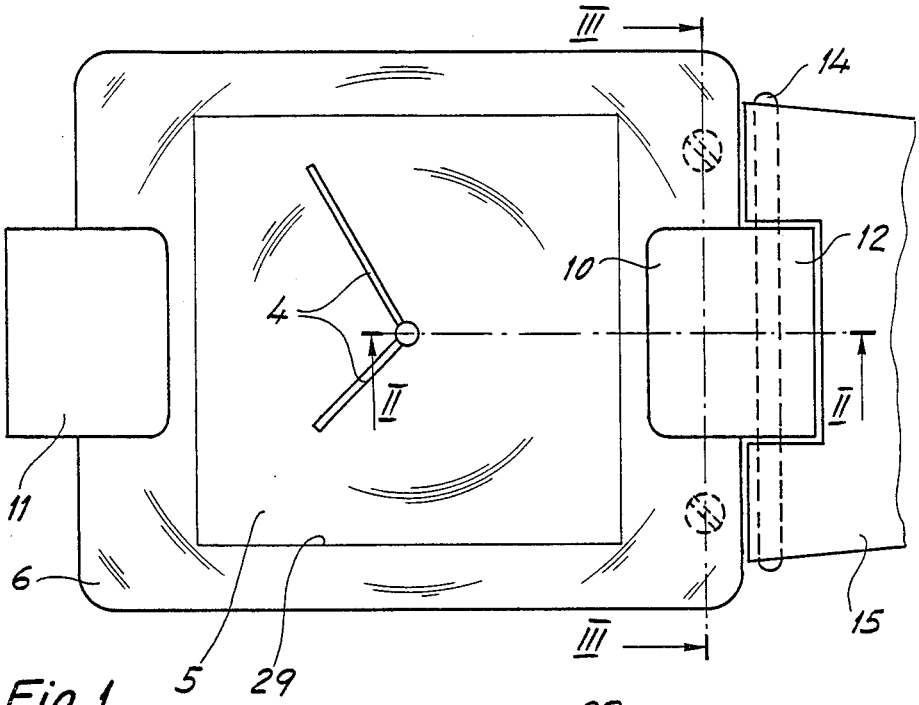
FIG. 1 is a top view of a watch case according to the invention in a first form of execution thereof.
Figure 2:
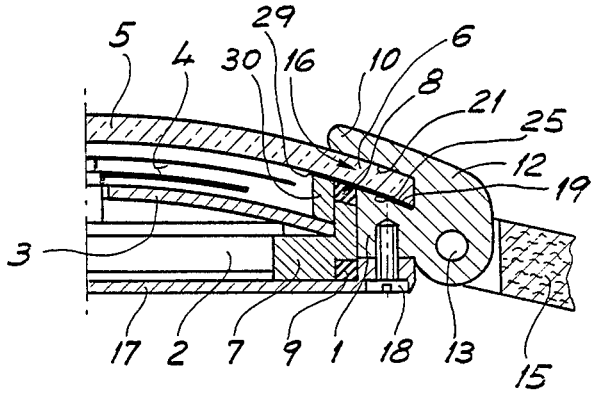
FIGS. 2 and 3 are cross-sections of the case of FIG. 1 respectively along lines II—II and III—III.
Figure 3:
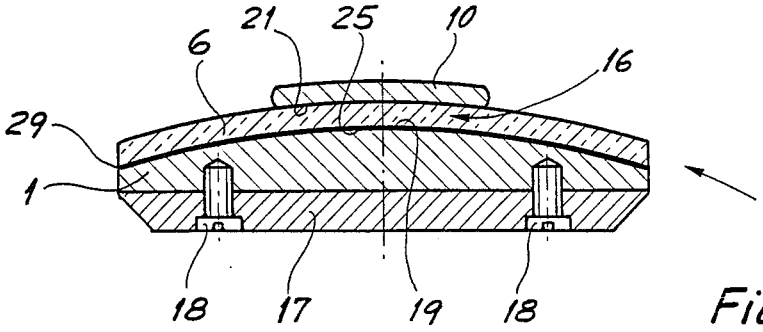

FIGS. 1, 2 and 3 show a watch case according to a first form of the invention. This case comprises a case band 1 on the interior of which is housed a movement 2 surmounted by a dial 3. Above the dial appear hands 4. The case comprises further a crystal 5 the peripheral zone 6 of which covers entirely the caseband 1. A casing ring 7 is disposed between the movement 2 and the caseband 1. The casing ring 7 bears on its upper portion a moisture resisting packing 8. As shown in FIG. 2, the casing ring is arranged to include further a second packing 9. The case further includes two supports 10 and 11 which face one another and which are fixed to the caseband 1. The supports 10 and 11 each exhibit a portion 12 which projects beyond the lateral walls of the caseband. In this portion 12 is provided a hole 13 in which a lug 14 is threaded to maintain in place a bracelet 15. Supports 10 and 11 form with the caseband 1 slots 16 in which the crystal 5 may be engaged by its peripheral zone 6. The crystal 5 further bears on its lower surface metallization 29 intended to hide from view the upper edge 19 of the caseband, the packing 8 and the flange 30.

FIG. 2 shows a support 10 integrally formed with the caseband 1 having a portion 12 serving to attach a bracelet. It will however be noted that support 10 could be fixed to the caseband without being integral therewith. It could for instance be fastened by means of screws. In the same manner, support 10 might not necessarily include portion 12 and hole 13 but provide a simple joining member for uniting the support to the case band.

The case further includes means for displacing the casing ring 7 which are operable from outside the case in order to compress the packing 8 against the internal surface of crystal 5. It may be seen in FIG. 2 that the case includes a back cover 17 screwed to the caseband 1 by screws 18.

It will be understood that when one screws on the back cover 17 the casing ring 7 is displaced upwardly and thus compresses the packing 8 against the internal surface of the crystal, thus to block the crystal against supports 10 and 11 and at the same time render the case water resistant from above and about its entire periphery, the seal 8 exhibiting the form of a ring running entirely around the case.

According to the construction shown on FIG. 2, the casing ring 7 is independent from the back cover. It is then necessary in order to render the case water resistant from below, to provide the second packing 9. On the other hand, if the casing ring 7 were to be manufactured integrally with the back cover 17, packing 9 would be superfluous.

According to the construction shown on FIG. 3, it is noted that the edge of crystal 6 is flush with the edge of caseband 1. This situation is not necessary for practising the invention and one may have arrangements where the crystal is slightly retracted relative to the caseband to provide the watch with a special aesthetic effect. In this case the peripheral zone 6 of the crystal only partially covers the caseband.

There will now be described the essential characteristic of the invention. As may readily be seen on FIGS. 2 and 3, the crystal 5 exhibits at least in its peripheral zone 6 a spherical form of substantially constant thickness. In the drawings, this sphericity is continued over the entire crystal. One could however provide other realizations where within the peripheral zone 6 towards the center of the watch the crystal would have another radius of curvature.

In accordance with the invention and as may be seen on FIGS. 2 and 3, the upper surface 19 of the caseband provides the form of a portion of a sphere of which the radius is substantially equal to the radius of the internal surface 25 forming part of the peripheral zone 6 of the crystal.

In other words, the crystal, once in place but not yet fastened, rests with its spherical interior surface on the top of the caseband, itself likewise having a spherical curvature of the same radius as that of the interior surface 25 of the crystal.

Reference will now be had to FIG. 4 in order to understand how one assembles the watch case according to the invention. In this figure there has been shown only the caseband 1 with supports 10 and 11 which are integral therewith. The upper surface 19 of the caseband exhibits the form of a portion of a sphere and forms with supports 10 and 11 slots 16. The crystal 5 is shown separated from the caseband. Initially, the internal surface 25 of crystal 5 is caused to slide over the upper surface 19 of the caseband in the direction of arrow 20. The crystal is then given a rotational movement which naturally results from sliding of the spherical surface presented by the lower surface of the crystal on the portion of the sphere shown by the top of the caseband 19. By continuing the same movement, the peripheral zones 6 of crystal 5 are made to penetrate into slots 16 and this continues until the periphery of the crystal coincides with the edge of the caseband. Thereafter, the packing is compressed (not shown on this drawing) against the internal surface of the crystal by operating the displacement means of the casing ring (not shown) in order to block the crystal 5 against supports 10 and 11.

As may be further seen on FIGS. 1 and 2, supports 10 and 11 extend over the upper surface of the crystal at least until they are aligned with the packing 8. In this manner, one may employ very thin crystals on the order of 0.5 to 0.8 mm of thickness since deformations are avoided which might take place at the contact surfaces and which could have as a consequence poor sealing at the edges of the crystal not covered by the supports.

The watch case shown on FIGS. 1 to 4 likewise shows that one may employ a case of non-circular form where the crystal is a spherical cap truncated in accordance with a rectangular configuration cut in order to match the form of the case. Supports 10 and 11 are located at rectilinear portions along the periphery of the crystal. Other forms might be envisaged for the periphery of the case. One could for example provide a form having two rounded portions and two linear portions or further a hexagonal form. In all these variants it is possible to employ a spherical crystal if use is made of the claimed means.

In the special construction shown on FIGS. 1 to 4 are employed supports 10 and 11 which extend over a large part of the rectilinear portions shown by the periphery of the case. In this case it will be understood that it is necessary that the internal surface 21 of supports 10 and 11 likewise exhibit the form of a portion of a sphere of which the radius is substantially equal to the radius of the peripheral external zone of the crystal cap. In this manner one is enabled to obtain a good distribution of the blocking forces acting on the crystal. It likewise permits to bestow on the object a desirable aesthetic form.

FIG. 5 is a variant of the construction shown on FIG. 2. It is distinguished therefrom only by the form of the slots 22 formed on the one hand by the support 23 of which the internal surface is cut in a bevel and on the other hand by the portion of the sphere shown by the top of the caseband 19 such as was already used in the construction shown on FIG. 2. In the construction of FIG. 5, the edge of crystal 5 is angled to from bevel 24. When the back cover 17 is applied to the caseband by means of screw 18, the casing ring 7 is displaced upwardly and the packing 8 is compressed against the internal surface of the crystal thereby to block the bevelled glass against the bevel of the support 23. In this variant the assembly of the case is the same as that which has been described in respect of the preceding figures where in a first operation the internal surface of the crystal is slid over the upper surface of the caseband with a rotational movement until the periphery of the crystal coincides with the edge of the caseband and thereafter the crystal is blocked against the supports of the caseband.

Figure 6:
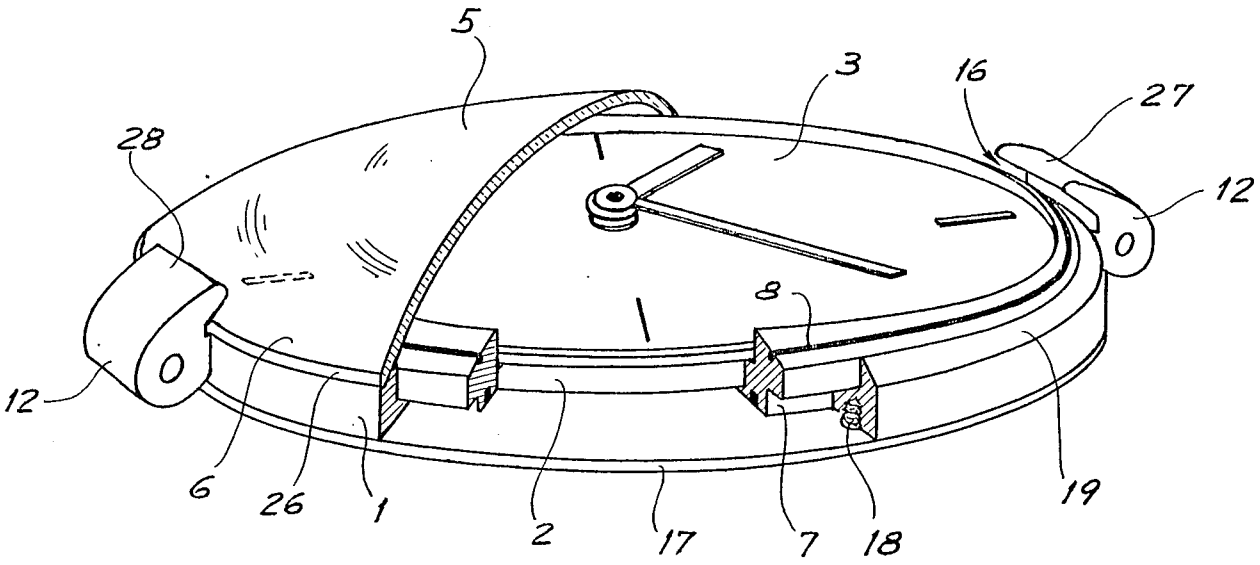
FIG. 6 is a perspective view of a watch case according to the invention and in a second form of execution.

FIG. 6 is a perspective view of a watch case according to the invention and in accordance with a second form thereof. Herein there is a round case on which is arranged a crystal having the form of a spherical cap with a circular periphery 26. One will recognize on the drawing the caseband 1, the casing ring 7 in which is provided a groove receiving packing 8, back cover 17 fixed to the caseband by means of screws 18, the crystal 5, the movement 2 and the two supports facing one another which are in the form of claws 27 and 28. The peripheral zone 6 entirely covers caseband 1. In order to introduce the crystal into slot 16 it will be understood that supports 26 and 27 must be of small width and that the bottom of slot 16 must be rectilinear to enable passage of the full diameter of the crystal during the introduction of the latter.

FIG. 6 will show readily the very thin aspect of the watch case realized according to the means proposed by this invention. This impression of thinness is given on the one hand by the fact that the crystal covers the caseband and on the other hand since the crystal is convex this permits placing the peripheral zone of the crystal below the level of dial 3.

Figure 7:
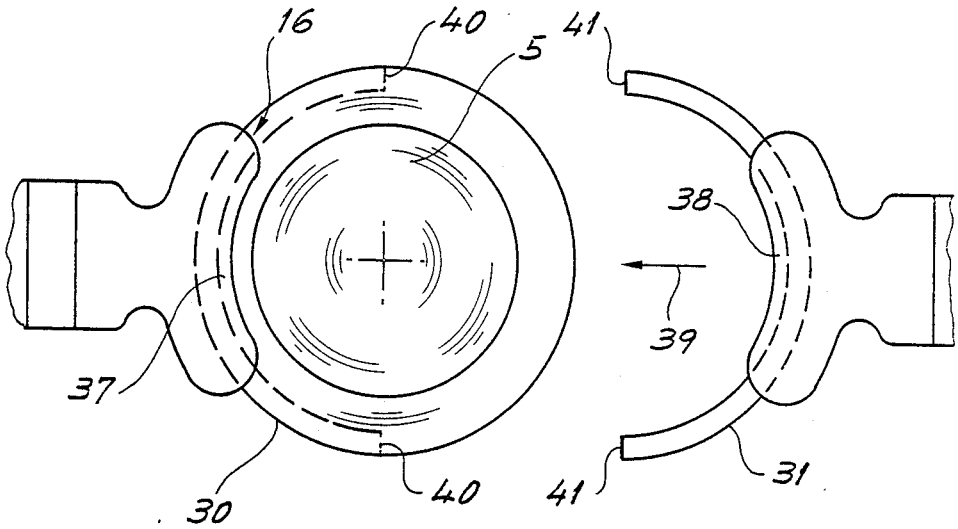
FIG. 7 is a top view of a watch case partially assembled according to a third form of execution of the invention.

FIG. 7 is a top view of a watch case partially assembled according to a third form of the invention. It has been said in respect of FIG. 6 that the supports must be of small width if one wishes to be able to introduce the crystal. The construction shown on FIG. 7 shows two supports 37 and 38 extending over a substantial arc of a circle which would render impossible the assembly of the crystal as explained in respect of FIG. 6. To overcome this difficulty there is employed a caseband made in two parts 30 and 31. For the assembly of the case initially the internal surface of the crystal 5 is caused to slide on the upper surface of the caseband 30 according to the rotation movement already mentioned until the crystal is lodged at the bottom of the slot 16 formed by support 37 and caseband 30. Next by the same rotational movement the upper surface of the caseband 31 is caused to slide under the crystal in the sense of arrow 39 until said crystal penetrates entirely into the slot formed from caseband 31 and support 38. At this time the two portions 30 and 31 are juxtaposed and contact one another at their edges 40 and 41. One continues the assembly in introducing from below the casing ring, packing and movement, the assembly being completed by screwing the back cover onto the caseband as has already been explained in respect of the preceding figures.

It will be noted that this procedure also permits assembly of a caseband having more than two supports. For instance, in the case of FIG. 7, in addition to supports 37 and 38, one may have two further supports located in quadrature at the place of joints 40, 41. These further supports could then each be made in two parts, one belonging to the caseband 30 and the other to caseband 31. This manner of assembly may also be employed for rectangular form watch cases where each of the four edges of the crystal is retained by a support, two thereof serving to attach a bracelet and the other two serving as decoration.

From the description of the forms which have just been given, it will be noted that this system of assembly as well as fixing of the crystal permits an easy assembly of the watch case.

In the case where the supports are realized integrally with the caseband, the assembly of the crystal by sliding according to a circular arc is the most appropriate means. In the case where the supports are fixed to the caseband by screws for instance, one could initially apply the crystal to the caseband from above, then fix the supports thereafter. Such however requires two simultaneous actions which complicates the assembly and which may cause breakage or deformation of the crystal since it will then be necessary to bear down on the latter during the fastening of the supports to the caseband. According to this invention, the supports are initially fastened and only thereafter one proceeds to place the crystal and the fixation thereof by the displacement means as described.

What we claim is:

1. A watch case, comprising: a back cover (17), a caseband (1) defining a housing for receiving a movement (2) surmounted by a dial (3), a crystal (5) having a surrounding, outer peripheral zone (6) at least partially overlying an upper surface of the caseband, a casing ring (7) disposed between the movement and the caseband and including a moisture resistant packing (8) on an upper surface thereof, at least two supports (10, 11) individually united with the caseband on opposite ends thereof and defining therewith respective slots for accommodating opposite peripheral zones of the crystal, and means (18) accessible from the case exterior for displacing the casing ring to compress said packing against an internal peripheral surface of the crystal and block said crystal against said supports, said crystal having a spherical curvature of constant radius in said peripheral zone, the thickness of the crystal being substantially constant in said zone, and the upper surface of the caseband having a spherical curvature of constant radius substantially equal to the radius of curvature of the internal surface of the crystal in said peripheral zone such that during assembly the crystal may be slid laterally over the upper surface of the caseband and attendantly rotated about a center of curvature thereof to a position whereat its peripheral zone at least partially overlies the upper surface of the caseband and underlies inwardly extending overhangs of the support slots.

2. A watch case as set forth in claim 1 wherein the edge of the crystal is angled to form a bevel (24) cooperating with the supports, the inner surface of which is cut in a bevel.

3. A watch case as set forth in claim 1 wherein the supports extend inwardly a sufficient distance over the upper surface of the crystal to overlie the packing.

4. A watch case as set forth in claim 1 having a rounded form, the crystal being in the form of a spherical cap with a circular periphery and the supports being in the form of claws of small width.

5. A watch case as set forth in claim 1 of non-circular form, the crystal being in the form of a spherical cap with a periphery truncated to match the form of the case, the supports being located at rectilinear portions of said periphery.

6. A watch case as set forth in claim 5 wherein the supports extend over a major part of the rectilinear parts of the case periphery, the internal surface (21) of the supports having the form of part of a sphere the radius of which is substantially equal to the radius of the external peripheral zone of the cap.

7. A watch case as set forth in claim 1 wherein the caseband is formed by two juxtaposed members (30, 31).

8. Method of assembling a watch case as set forth in claim 1 including the following steps:

sliding the internal surface of the crystal over the upper surface of the caseband with a rotational motion resulting from the sliding of a spherical surface over a portion of a sphere;

continuing said sliding movement so as to effect penetration of the peripheral zones of the crystal into the slots formed by the supports and the caseband until the periphery of the crystal coincides with the edge of the caseband and compressing the packing against the internal surface of the crystal by the operation of the casing ring displacement means thereby to block the crystal against the supports.

9. A watch case as set forth in claim 1, wherein said two supports are integral with the caseband.

10. A watch case as set forth in claim 1, wherein internal surfaces of the support slots also have a spherical curvature of constant radius substantially equal to the radius of curvature of the internal surface of the crystal in said peripheral zone.

* * * * *